United States Patent [19]

White

[11] Patent Number: 4,833,369

[45] Date of Patent: May 23, 1989

[54] CONSTANT SPARK RATE IGNITION EXCITER

[75] Inventor: Robert C. White, La Mesa, Calif.

[73] Assignee: Sundstrand Corp., Rockford, Ill.

[21] Appl. No.: 108,081

[22] Filed: Oct. 14, 1987

[51] Int. Cl.[4] ..... F02P 3/08; F02P 5/04

[52] U.S. Cl. ..... 315/209 T; 315/209 CD; 315/209 SC; 315/240; 315/307; 123/605; 123/606; 123/596; 60/39.06

[58] Field of Search ..... 315/209 T, 209 CD, 209 SC, 315/239, 240, 242, 77, 307, 224, 225, 123/596, 598, 604, 605, 606, 625, 629; 60/39.06; 323/299

[56] References Cited

U.S. PATENT DOCUMENTS

| | | | |
|---|---|---|---|
| 3,045,148 | 7/1962 | McNulty et al. | 315/183 |
| 3,267,329 | 8/1966 | Segall | 315/183 |
| 3,424,945 | 1/1969 | Seider et al. | 315/240 |
| 3,666,989 | 5/1972 | Boyer | 315/219 |
| 3,714,507 | 1/1973 | Schweitzer et al. | 123/604 X |
| 3,731,143 | 5/1973 | Thakore | 315/209 T |
| 3,835,350 | 9/1974 | Thakore | 315/209 T |
| 3,869,645 | 3/1975 | Collins | 315/209 T |
| 4,083,347 | 4/1978 | Grather et al. | 123/610 |
| 4,121,556 | 10/1978 | Bigliani | 123/610 |
| 4,228,778 | 10/1980 | Rabus et al. | 123/605 |
| 4,248,195 | 2/1981 | Gorille et al. | 315/209 T X |
| 4,414,804 | 11/1983 | Menard et al. | 60/39.141 |
| 4,448,181 | 5/1984 | Ishikawa et al. | 123/598 X |
| 4,479,467 | 10/1984 | Burrows et al. | 123/605 X |
| 4,696,280 | 9/1987 | Niggemayer | 123/598 |

*Primary Examiner*—Palmer C. DeMeo
*Assistant Examiner*—Mark R. Powell
*Attorney, Agent, or Firm*—Antonelli, Terry & Wands

[57] ABSTRACT

A constant spark rate ignition exciter is disclosed which functions to store a predetermined constant amount of energy in an energy storage element of an ignition system independent of power supply variations. A first embodiment of the invention is a capacitive discharge ignition system. A second embodiment of the invention is an inductive discharge ignition system. Each embodiment produces the constant frequency ignition pulses by the counting of a predetermined count in a counter. The interval during which energy is stored in energy storage elements of the embodiments of the invention is determined by sensing the power supply potential and controlling the time interval for coupling the power supply to the energy storage element in a manner which is inversely proportional to the sensed voltage.

11 Claims, 2 Drawing Sheets

CONSTANT SPARK RATE IGNITION EXCITER

BACKGROUND OF THE INVENTION

1. Field of the Invention

The present invention relates to constant spark rate ignition systems which store a predetermined amount of energy for the generation of each spark independent o power supply variations.

2. Description of the Prior Art

Ignition exciters for gas turbines currently in use are predominantly simple capacitive discharge units. They consist of a free running saturable core inverter, a storage capacitor, a firing device (usually a gas filled diode) and a high tension transformer whose secondary supplies the energy to the ignition plug. No regulation is attempted for variation in power supply voltage which is common in battery systems to which gas turbine engines are connected.

Spark ignition exciters based upon inductive discharge are also known. In an inductive discharge system, a current is built up in the primary of a transformer which is interrupted by the open circuiting of the switch to generate each spark.

Ignition systems are known which compensate for variation in power supply voltage so that the energy stored per spark is constant irregardless of the variation in the supply voltage. See U.S. Pat. Nos. 3,666,989, 3,714,507, 3,731,143, 3,835,350 and 4,083,347.

SUMMARY OF THE INVENTION

The present invention is a capacitive discharge ignition system and an inductive discharge ignition system having a constant spark rate and constant energy per spark which operates satisfactorily with variations in the potential of a power supply over a wide range. The system is especially suited for gas turbine engines which have ignition plugs which are fired at a constant frequency and in which it is desired to have each spark have constant energy.

The present invention has two embodiments. The first embodiment is a capacitive discharge ignition system for producing constant energy ignition pulses across an ignition plug occurring at a constant frequency for use with a power supply having a potential subject to variation and the second embodiment is an inductive discharge ignition system for producing constant energy ignition pulses across an ignition plug occurring at a constant frequency for use with a power supply having a potential subject to variation.

A capacitive discharge ignition system for producing constant energy ignition pulses across an ignition plug occurring at a constant frequency for use with a power source having a potential subject to variation includes a capacitor for storing charge; a pulse source for connection to the power source of the variable potential, responsive to a trigger pulse and a reference pulse, for applying pulses having a fixed frequency and a variable duration, inversely proportional to changes in the voltage of the power supply, to the capacitor during a charging interval between the reference pulse and the trigger pulse to store the charge for each ignition pulse of the ignition pulses; a counter, coupled to the pulse source for applying pulses, for producing a trigger pulse when a predetermined number of pulses has occurred from a first reference time and a reference pulse when a second reference time occurs a time interval after the first reference time, the time between the reference pulse and the trigger pulse defining the charging interval, a first transformer having a primary coupled to the capacitor and a secondary for connection to the ignition plug; and a switch having a pair of terminals connected in series between the capacitor and the primary and a control terminal permitting the conduction of current between the pair of terminals when the trigger pulse is applied thereto and interrupting the flow of current when the trigger pulse is absent. Preferably, the pulse source for applying pulses comprises a pulse width modulator. Further, the pulse source for applying pulses includes a second transformer having a primary coupled in series with a switch and a secondary coupled in series with the capacitor, one terminal of the primary to be coupled to the power supply of variable potential and another terminal of the primary being coupled to one of a pair of terminals of the switch through which current flows when a control signal is applied to the control terminal of the switch, another of the pair of terminals of the switch to be coupled to a reference potential of the power supply, the control signal being the pulses of fixed frequency and variable duration during the charging interval. The source for applying pulses further includes a flip-flop having set and reset inputs and an output, the reset input being derived from a lower order counting stage of the counter and the trigger pulse being derived from a higher counting stage of the counter. A driver is provided having a pair of terminals between which current will flow except when a control signal is applied to a control input, the control input being coupled to the output of the flip-flop, one of the terminals of the driver being coupled to an output of the pulse width modulator at which the pulses of the fixed frequency and variable duration are outputted and another of the terminals of the driver being coupled to the control terminal of the switch. The capacitive discharge ignition system further includes a diode having a pair of terminals, one of the terminals being coupled to a terminal of the secondary of the second transformer and the other one of the terminals being coupled to a terminal of the capacitor. The switch permitting the conduction of current between the pair of terminals when the trigger pulse is applied is preferably a silicon controlled rectifier with a control terminal coupled to receive the trigger pulse, its anode coupled t a terminal of the capacitive storage and its cathode coupled to the terminal of the primary of the first transformer. The capacitive discharge ignition system of the present invention further includes a trigger circuit coupled between a trigger pulse output of the counter and the control terminal of the silicon control rectifier for shaping and conditioning the trigger pulse.

An inductive discharge ignition system for producing constant energy ignition pulses across an ignition plug occurring at a constant frequency for use with a power source having a potential subject to variation includes a clock for producing clock pulses on an output of a predetermined frequency; a counter, coupled to the clock, for producing a trigger pulse on a trigger pulse output each time a predetermined number of clock pulses is counted; an inductor having a primary with a first terminal for connection to the potential subject to variation of the power source and a second terminal, and a secondary for connection to the ignition plug; a switch, having a pair of terminals between which current flows when a control signal is supplied to a control terminal, one of the pair of terminals being coupled to the second terminal of the primary and the other of the terminals being coupled to a reference potential; and a controller, responsive to the potential of the power supply, to a signal having a magnitude proportional to a current count of the counter and to the trigger pulse to produce the control signal between a time interval when signal exceeds a predetermined level of the power source and the occurrence of the trigger pulse. The controller includes a comparator having a first input coupled to the potential subject to variation and a second input coupled to the signal having a magnitude proportional to the current count for producing an output signal when the magnitude of the signal exceeds the predetermined level; and a flip-flop having set and reset inputs and an output, the set input being coupled to the output of the comparator, the reset input being coupled to the trigger pulse and the output of the flip-flop being coupled to the control terminal of the switch. The controller further includes a digital-to-analog converter, coupled to the current count of the counter and the second input of the comparator, for converting the current count to an analog value; and a driver, having an input coupled to the output of the flip-flop and an output coupled to the control terminal, for shaping and conditioning the output signal of the flip-flop.

DESCRIPTION OF THE PREFERRED EMBODIMENTS

Figure 1:
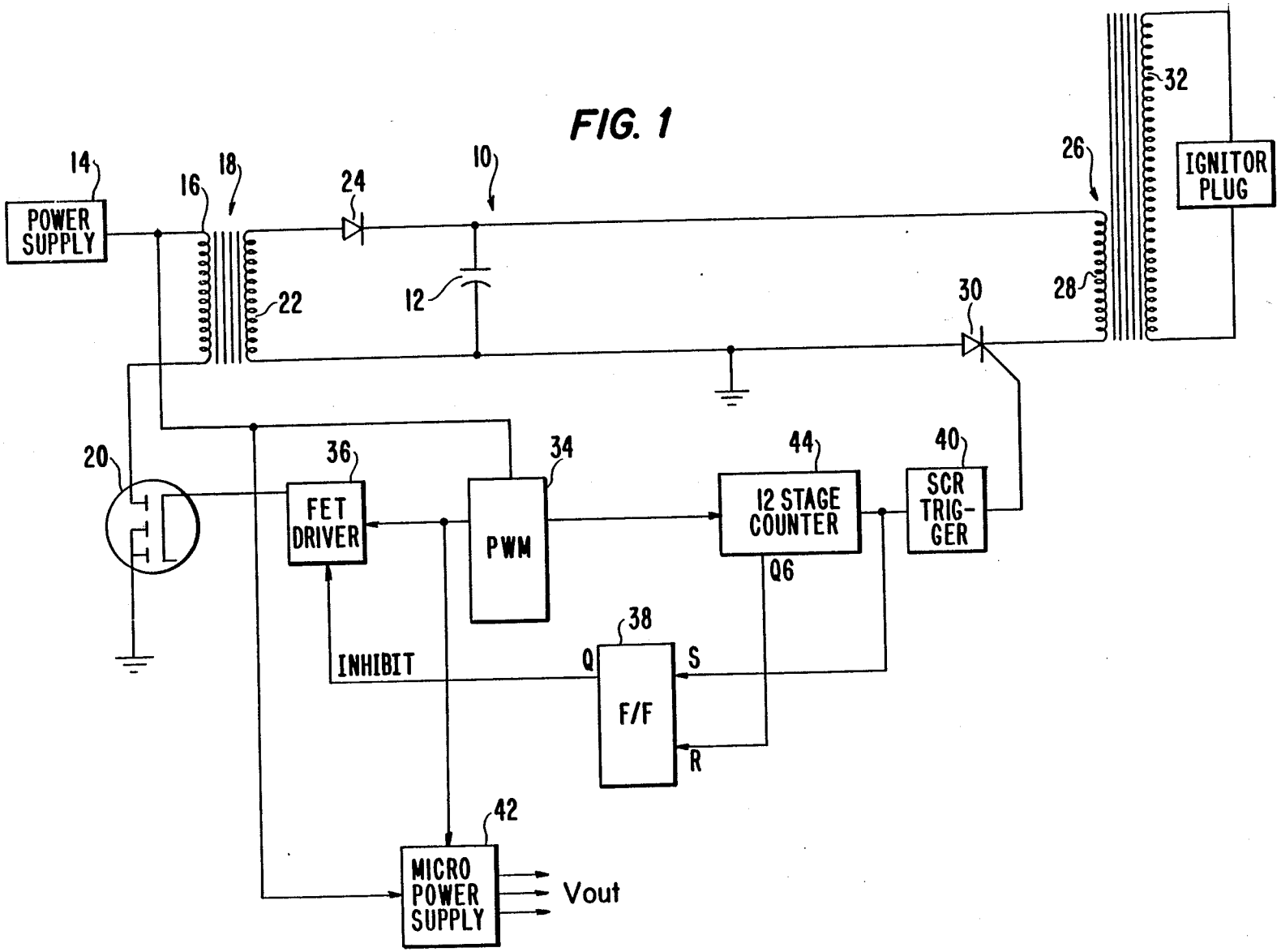
FIG. 1 illustrates a capacitive discharge ignition system in accordance with the present invention.

FIG. 1 illustrates a first embodiment of the present invention which is a capacitive discharge ignition system. The first embodiment of the present invention operates to store constant energy for each spark discharge in a capacitor 12 independent of variation in the power source potential 14. The capacitor 12 is charged by the conduction of current from the power supply 14 through the primary of transformer 18 through a switch 20, which preferably is a field effect transistor, to a reference potential. The voltage across the primary 16 is stepped up by the secondary 22 of transformer 18 to approximately 400 volts. Diode 24 controls the polarity of storage of charge on the capacitor 12. A second transformer 26 has a primary coupled to one of the terminals of the capacitor 12 and to the cathode of silicon control rectifier 30. The anode of the silicon control rectifier 30 is coupled to the other terminal of the capacitor 12. Triggering of the SCR 30 into conduction causes the discharge of the charge stored on the capacitor 12 through the primary 28 of transformer 26. The turns ratio of the transformer 26 determines the amount of step up of the voltage across the secondary 32 of the transformer 26. The secondary 32 is coupled to an ignition plug of a gas turbine of conventional construction.

The time interval during which switch 20 is conductive determines the amount of charge stored in the capacitor 12. A pulse width modulator 34 produces a series of output pulses having a duty cycle which is inversely proportional to the magnitude of a voltage sensed from the power supply 14. The output pulses are of a fixed frequency. A field effect transistor driver 36 amplifies the output pulses from the pulse width modulator 34, when an inhibit signal applied thereto is at a low level, to a level sufficient to control the conduction of the switch 20 by application to the control terminal. The pulses outputted by the pulse width modulator 34 are also applied to a twelve-stage counter which outputs a trigger pulse one each time 4,096 pulses from the pulse width modulator 34 are counted at the time an all zero carry occurs. After the trigger pulse is outputted, the counter again begins counting up to 4,096 to produce another trigger pulse. The counter may be a ring counter. If the pulse width modulator 34 is producing pulses at a frequency of 100 KHz, the trigger pulses will be produced 25 times per second. Flip-flop 38 controls the generation of the inhibit signal which causes the FET driver 36 to block the transmission of the pulses from the pulse width modulator 34 to the switch 20. The set terminal of the flip-flop 38 is controlled by the trigger pulse outputted from the twelfth stage of the twelve-stage counter 44. The reset terminal is controlled by the output of the sixth stage of the twelve-stage counter. An SCR trigger circuit 40 conditions and shapes the trigger pulse output from the twelve-stage counter 44 to a level sufficient to control the conduction of SCR 30. Power supply 42 functions to produce output potentials which are a function of the sensed potential of the power supply 14. The output signal from the pulse width modulator 34 is applied to the micro power supply 42 which functions as a DC to DC converter to produce output potentials which are a function of the sensed input potential.

The first embodiment of the present invention operates as follows. The charging interval of the capacitor 12 for each pulse of the ignition plug is defined by the time interval between the output from the sixth stage of the twelve-stage counter 44 and the trigger pulse which is outputted from the last stage of the counter. It should be understood that the present invention is not limited to the derivation of the reset signal for the flip-flop 38 from any particular stage of the counter. The overall time between the output signal used for resetting the flip-flop 38 and the output of the final stage of the counter should be sufficient to permit charge in the capacitor 12 to build up to the predetermined energy level at which the ignition system is to operate to produce pulses. The time at which the first stage of the counter 44 counts a logic one determines a first reference time marking the beginning of the time interval at which the ignition pulses cyclically repeat. The time at which the sixth stage of the counter 44 counts a logic one determines a second reference time marking the beginning of the charge interval for the capacitor 12. The trigger pulse output from the last stage defines the time at which the ignition pulse is to fire. The time between the output of the reset pulse from one of the stages of the counter 44 (second reference time) and the output of the trigger pulse which is applied to the set terminal of the flip-flop 38 determines the time interval during which the inhibit signal is low. When the inhibit signal is low, the output pulses from the pulse width modulator 34 are applied in an amplified form to the control terminal of the switch 20. The cyclical conduction of the switch 20 with a duration directly proportional to the duration of the pulses outputted by the pulse width modulator 34 produces a cyclical variation of current in the primary 16 of transformer 18 which is stepped up by the secondary 22 to a level of approximately 400 volts which is stored in the capacitor 12. Each time the counter 44 produces a trigger pulse, the SCR trigger amplifies the trigger pulse to a level sufficient to turn on the silicon control rectifier 30. Conduction of the silicon controlled rectifier 30 causes a capacitive discharge which produces a current flow through the primary 28 of transistor 26 which is stepped up by the secondary to a level sufficient to produce an ignition pulse across the ignition plug of the gas turbine engine. The effect of a pulse width modulator is to compensate for variations in the sensed potential of the power supply 14 to cause a predetermined charge to be stored on the capacitor 12 independent of power supply variation.

Figure 2:
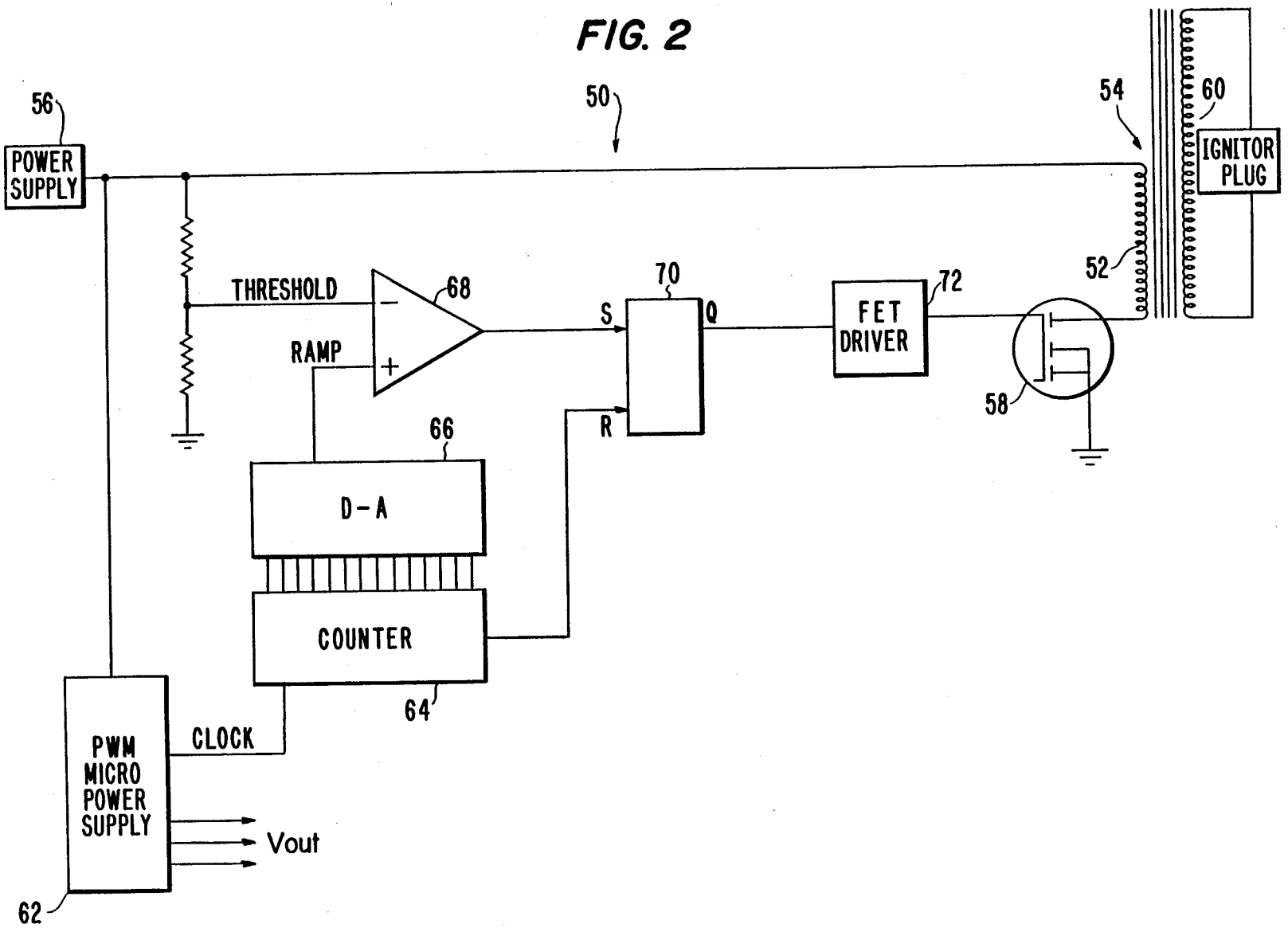
FIG. 2 illustrates an inductive discharge ignition system in accordance with the present invention.

FIG. 2 illustrates a second embodiment 50 of the present invention which is an inductive discharge ignition system. The primary 52 of inductor 54 is coupled between a power supply of variable potential 56 and a switch 58 which permits current to flow from the power source to ground when the switch is conductive. The secondary 60 of the inductor 54 steps up the potential across the primary when the switch 58 is open-circuited to a level to break down the spark gap in an ignition plug of a gas turbine engine. The cyclical interruption of current flow in the primary 52 of inductor 54 by switch 58 is the conventional operation of an inductive discharge ignition system. Ignition pulses are produced at a constant rate as described below.

This embodiment controls the conduction time interval of current through the primary 52 of the inductor 54 in a manner which is inversely proportional to a sensed voltage from the power supply 56. As the sensed voltage decreases, the time interval during which current flows in the primary 52 of transformer 54 is proportionally increased. Micro power supply 62 functions to produce output potentials and a clock signal having a constant frequency such as 100 KHz. The clock signal is applied to a counter 64 which may be a twelve-stage counter identical to that described in the first embodiment. The counter functions to count the number of clock pulses inputted from the micro power supply 62. When the counter counts up to the point where the last stage is high (4,096 cycles of the clock), a trigger pulse is produced. After the production of the trigger pulse, the counter again begins a counting cycle of counting the next 4,096 pulses. The counter may be a ring counter. A digital-to-analog converter 66 of conventional construction is coupled to the counter 64 to output a ramp having a magnitude which is directly proportional to the instantaneous count of the counter. A comparator 68 having an input coupled to the variable potential of the power supply 56 and an input from the digital-to-analog converter 66 produces a high level output pulse when the level of the ramp exceeds the threshold voltage. It is thus seen that the comparator functions to produce a high level output pulse at a time measured with respect to the beginning of the counting cycle of the counter 64 which is directly proportional to the sensed voltage of the power supply 56. The lower the magnitude of the sensed power supply potential 56, the sooner the high level output pulse is produced by the comparator 68. Flip-flop 70 controls the generation of the control signal for the switch 58 during which current flows from the power supply 56 through the primary 52 of transformer 54 through switch 58 to ground. When the output from the comparator 68 goes high, the output from the flip-flop 70 goes high. The output from the flip-flop 70 goes low upon the generation of the trigger pulse by the counter 64. The output pulse from the flip-flop 70 is amplified by an FET driver circuit 72 to a level sufficient to control the control terminal of switch 58.

The second embodiment operates as follows. The cyclical interval during which ignition pulses are generated is determined by the counting of a predetermined number of pulses by the counter 64. The counting of this predetermined number of pulses produces the trigger pulse. The interval during which current conducts from the power supply 56 through the primary 52 of inductor 54 through the switch 58 to ground is the elapsed time between the generation of the high level output pulse from the comparator 68 and the generation of the trigger pulse by the counter 64. The time interval between the energy pulse and when the output from the threshold 68 goes high is directly proportional to the sensed voltage from the power source 56. For lower potentials of the power supply 56, the output pulse from the comparator 68 goes high after the elapsing of a time interval proportionately closer to the trigger pulse of the counter 64 than for higher potentials. The overall effect of the aforementioned sequence is to store a predetermined amount of energy in the primary 52 of the inductor 54 independent of variations in the power supply 56 while producing ignition pulses at a constant frequency.

While the invention has been described in terms of its preferred embodiments, numerous modifications may be made thereto without departing from the spirit and scope of the invention. It is intended that all such modifications fall within the scope of the appended claims.

I claim:

1. A capacitive discharge ignition system for producing ignition pulses across an ignition plug occurring at a constant frequency and having a constant energy level for use with a power source having a potential subject to variation comprising:

(a) a capacitor for storing charge;

(b) means for connection to the power source of variable potential, responsive to a trigger pulse and a reference pulse, for applying pulses having a fixed frequency and a variable duration, inversely proportional to the voltage of the power supply, to the capacitor during a charging interval between the trigger pulse and the reference pulse to store the charge for each ignition pulse of the ignition pulses;

(c) counting means, coupled to the means for applying pulses, for producing a trigger pulse when a predetermined number of pulses has occurred from a first reference time and a reference pulse when a second reference time occurs an interval after the first reference time, the time between the reference pulse and the trigger pulse defining the charging interval;

(d) a first transformer having a primary coupled to the capacitor and a secondary for connection to an ignition plug; and (e) a switching means, having a pair of terminals connected in series between the capacitor and the primary and a control terminal for permitting the conduction of current between the pair of terminals when the trigger pulse is applied thereto and interrupting the flow of current when the trigger pulse is absent.

2. A capacitive discharge ignition in accordance with claim 1 wherein the means for applying pulses comprises:

a pulse width modulator.

3. A capacitive discharge ignition in accordance with claim 2 wherein the means for applying pulses further comprises:

a second transformer having a primary coupled in series with a switch and a secondary coupled in series with the capacitor, one terminal of the primary to be coupled to the power supply of variable potential and another terminal of the primary being coupled to one of a pair of terminals of the switch through which current flows when a control signal is applied to a control terminal of the switch, another of the pair of terminals of the switch to be coupled to a reference potential of the power supply, and the control signal being the pulses of fixed frequency and variable duration during the charging interval.

4. A capacitive discharge ignition system in accordance with claim 3 wherein the means for applying pulses further comprises:

(a) a flip-flop having set and reset inputs and an output, the reset input being derived from a lower order counting stage of the counting means and the trigger pulse being derived from a higher order stage of the counting means; and (b) a driver having a pair of terminals between which current will flow except when a control signal is applied to a control input, the control input being coupled to an output of the flip-flop, one of the terminals of the driver being coupled to an output of the pulse width modulator at which the pulses of the fixed frequency and variable duration are outputted and another of the terminals of the driver being coupled to the control terminal of the switch.

5. A capacitive discharge ignition system in accordance with claim 3 further comprising:

a diode having a pair of terminals, one of the terminals being coupled between a terminal of the secondary of the second transformer and a terminal of the capacitor.

6. A capacitive discharge ignition system in accordance with claim 1 wherein the switching means comprises:

a silicon controlled rectifier with a control terminal coupled to receive the trigger pulse, an anode coupled to a terminal of the capacitor and a cathode coupled to a terminal of the primary of the first transformer.

7. A capacitive discharge ignition system in accordance with claim 6 further comprising:

a triggering means coupled between a trigger pulse output of the counting means and the control terminal of the silicon controlled rectifier for shaping the trigger pulse.

8. A capacitive discharge ignition system in accordance with claim 1 wherein the ignition plug is in a gas turbine engine.

9. An inductive discharge ignition system for producing ignition pulses of constant energy across an ignition plug occurring at a constant frequency for use with a power supply having a potential subject to variation comprising:

(a) a clock for producing clock pulses on an output of a predetermined frequency;

(b) counting means, coupled to the clock, for producing a trigger pulse on a trigger pulse output each time a predetermined number of clock pulses is counted;

(c) an inductor having a primary with a first terminal for connection to the potential subject to variation of the power supply and a second terminal, and a secondary for connection to the ignition plug;

(d) switching means, having a pair of terminals between which current flows when a control signal is applied to control terminal, one of the pair of terminals being coupled to the second terminal of the primary and the other of the terminals being coupled to a reference potential; and (e) control means, responsive to the potential of the power supply, to a signal having a magnitude proportional to a current count of the counter, and to the trigger pulse to produce the control signal between a time interval when the signal exceeds a predetermined voltage level of the power supply and the occurrence of the trigger pulse.

10. An inductive discharge ignition system in accordance with claim 9 wherein the control means comprises:

(a) a comparator having a first input, coupled to the potential of the power supply and a second input coupled to the signal, having a magnitude proportional to a current count of the counter for producing an output signal when the magnitude of the signal exceeds the predetermined voltage level of the power supply; and (b) a flip-flop having set, and reset inputs and an output, the set input being coupled to the output of the comparator, the reset input being coupled to receive the trigger pulse and the output of the flip-flop being coupled to the control terminal of the switching means.

11. An inductive discharge system in accordance with claim 10 wherein the signal is produced by:

(a) a digital-to-analog converter having an input coupled to the current count of the counting means and an output coupled to the second input of the comparator for converting the current count to an analog value; and further comprising (b) a driver, having an input coupled to the output of the flip-flop and an output coupled to the control terminal of the switching means, for amplifying the output signal of the flip-flop.

* * * * *